United States Patent [19]

Miller

[11] 3,950,745

[45] Apr. 13, 1976

[54] ELECTRICAL WARNING AND SWITCHING MEANS AND SYSTEM

[75] Inventor: Gerald K. Miller, Hersey, Mich.

[73] Assignee: Nartron Corporation, Reed City, Mich.

[22] Filed: Aug. 27, 1974

[21] Appl. No.: 500,895

[52] U.S. Cl. ..... 340/412; 340/213 R; 340/326

[51] Int. Cl.[2] ..... G08B 7/00

[58] Field of Search ..... 340/52 R, 52 F, 213 R, 340/412, 326

[56] References Cited

UNITED STATES PATENTS

| | | | |
|---|---|---|---|
| 3,597,729 | 8/1971 | Lopez | 340/52 F |
| 3,772,642 | 11/1973 | Schlorke | 340/52 F |
| 3,810,149 | 5/1974 | Miller | 340/384 E |
| 3,815,110 | 6/1974 | Davidson | 340/213 R |

*Primary Examiner*—Harold I. Pitts
*Attorney, Agent, or Firm*—Lon H. Romanski

[57] ABSTRACT

An electrical warning and switching system employs an assembly, provided with an electromagnetic assembly, a plurality of connector terminals, plurality of diode means and a plurality of electrical connectors or terminals for connection within an overall system. Means are employed sensitive to various parameters to be sensed and additional means effective to convey a waring signal or a control function in the event of the occurrence of a predetermined condition within such various parameters.

12 Claims, 16 Drawing Figures

ELECTRICAL WARNING AND SWITCHING MEANS AND SYSTEM

BACKGROUND OF THE INVENTION

Heretofore, especially in automobile and truck applications, it has become desirable to sense various operating parameters as well as other vehicular conditions reflective of, for example, vehicle and/or passenger safety.

In an attempt to satisfy such attendant sensing requirements, the prior art has, heretofore, provided a plurality of sensing devices for respectively sensing a plurality of operating parameters and then supplied a plurality of warning devices respectively actuatable directly in response to the respective operation of said plurality of sensing devices. This basic approach has proven to be extremely costly and not totally reliable. Usually, such prior art systems are tailored as to have, for example, a particular sensor and cooperating warning device employable for only one particular application and, therefore, this, in turn, requires the greatly added expense of providing different tooling and testing equipment for the manufacturing of each such sensor and warning device combination as well as the added expense of installing each such combination within the vehicle.

Further, dependability of the overall system employing such respective pluralities of sensors and warning devices is often effected by, for example, the human qualities of the vehicle operator. That is, often it occurs that one particular combination of a first sensor and cooperating first warning device has functioned to provide the desired warning signal or attendant control function. Because of the operator being aware that he has in fact received such a signal, he often assumes that all of the other combinations of respective sensors and warning devices are also operative whereas, in fact, any one of the other combinations may have experienced failure as in, for example, the warning device because of such destructive influences as excessive vibrations and/or temperature.

Accordingly, the invention as herein disclosed and described is primarily concerned with the solution of the above as well as other related and attendant problems.

SUMMARY OF THE INVENTION

According to the invention a warning assembly comprises electromagnetic means effective for creating an audio signal, a plurality of electrical connector means adapted for electrical connection to a plurality of associated indicia sensing means and to a related source of electrical potential, electrical circuit means electrically connecting said plurality of electrical connector means to said electromagnetic means, and a plurality of diode means in said electrical circuit means effective to prevent energization of selected other associated warning devices whenever said electromagnetic means is energized and the energization of only one of such other associated warning devices is desired.

Various general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENTS

Figure 1:
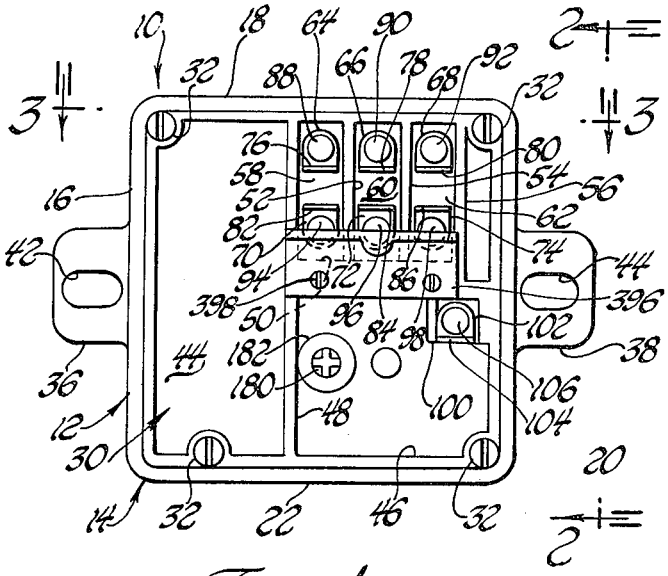
FIG. 1 is a top plan view of a warning assembly constructed in accordance with the teachings of the invention.
Figure 2:
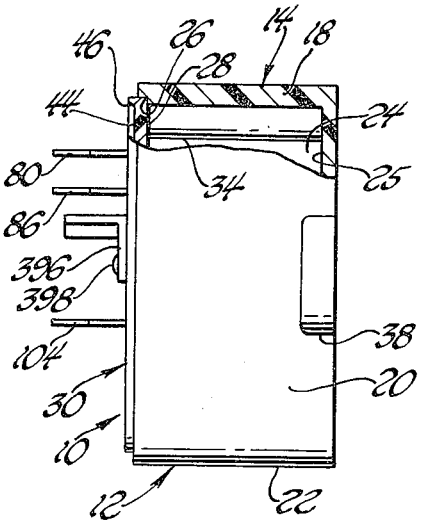
FIG. 2 is a side elevational view, with portions broken away and in cross-hatching, of the structure of FIG. 1, taken generally on the plane of line 2—2 of FIG. 1 and looking in the direction of the arrows.

Referring now in greater detail to the drawings, in FIGS. 1 and 2, the apparatus 10 is illustrated as comprising a housing assembly 12 having a main container 14 with integrally formed side walls 16, 18, 20 and 22 and an integrally formed rearward end wall 25 extending transversely and joining side walls 16, 18, 20 and 22. The forward or front end of container 14 is provided with an opening generally defined by side walls 16, 18, 20 and 22 for the reception therethrough and into the inner chamber 24 of container 14 of related structure to be described.

A step or flange-like surface 26 is formed at the forward end of walls 16, 18, 20 and 22 as to be generally coextensive therewith and to thereby provide an abutment or seating surface for the reception thereagainst of the inner surface 28 of a cooperating cover plate or forward end wall 30. The cover 30 may be secured in any suitable manner; however, in the preferred embodiment, a plurality of screws 32, extending through cover 30, are threadably engaged with cooperating apertures formed within enlarged cylindrical-like portions integrally formed within container 14 and along the side walls 16, 18, 20 and 22 as typically illustrated at 34 of FIG. 2.

The conainer 14 is also preferably provided with integrally formed laterally extending tab or bracket-like portions 36, 38 which, in turn, have apertures 40 and 42 formed therethrough by which the apparatus 10 may be suitably mounted, as by screws (not shown), to related support structure.

In the preferred embodiment, cover 30 is formed of a main planar body portion 44 with an integrally formed peripherally extending outwardly directed edge-wall 46. Further, a generally transversely extending rib portion 48 is also integrally formed with planar body portion 44 and integrally formed with a relatively wide raised rib portion 50 generally transverse thereto. Additional relatively short rib portions 52, 54 and 56 are formed integrally with planar body 44 and with edge-wall 46 as well as the relatively wide rib 50 to thereby define pocket-like areas 58, 60 and 62 adapted for the reception therein of the mounting bases 64, 66, 68, 70, 72 and 74 of respective electrical terminals or connectors 76, 78, 80, 82, 84 and 86. The pocket-like areas 58, 60 and 62 are of such a width as to closely confine the sides of such terminal bases and thereby prevent angular misalignment of such respective terminals even though they are respectively secured as by single electrically conductive rivets 88, 90, 92, 94, 96 and 98. An additional pocket-like area is defined generally between a rib-like portion 100 and edge-wall 46 to thereby similarly receive the base 102 of a connector or terminal 104 which is also secured as by an electrically conductive rivet 106.

Figure 3:
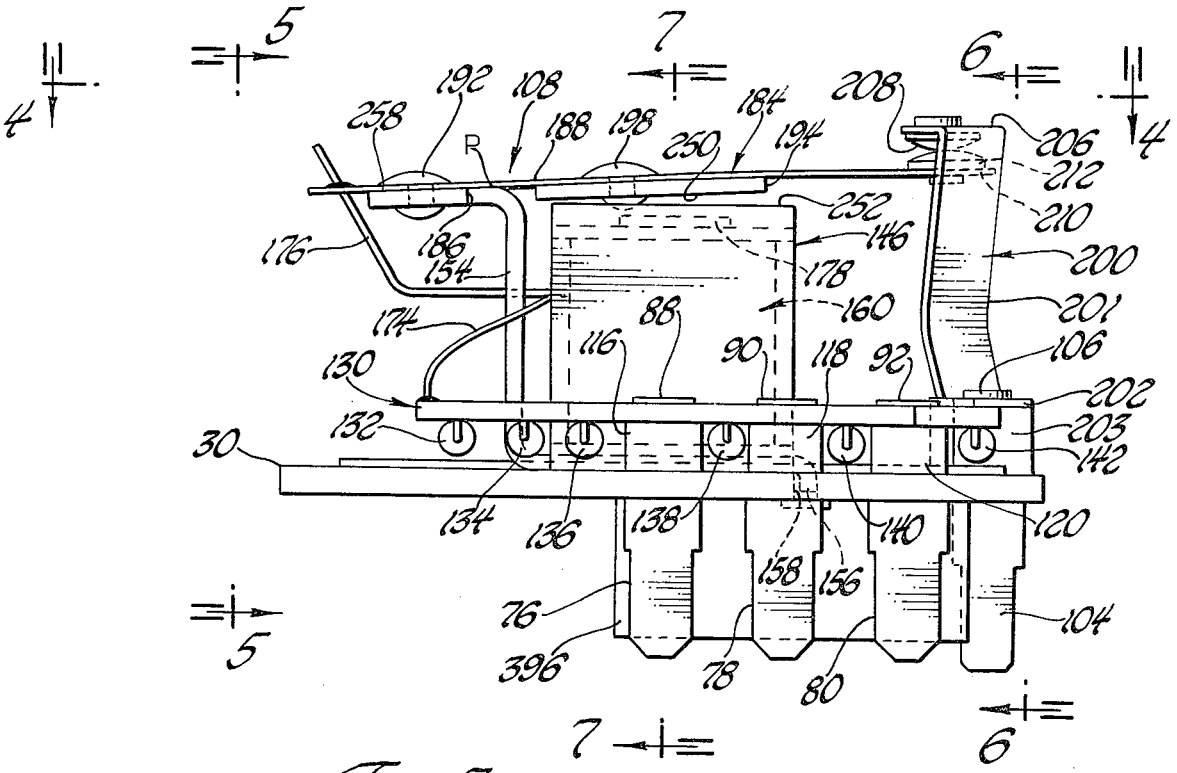
FIG. 3 is an enlarged view taken generally on the plane of line 3—3 of FIG. 1 and looking in the direction of the arrows with the other container member removed.
Figure 4:
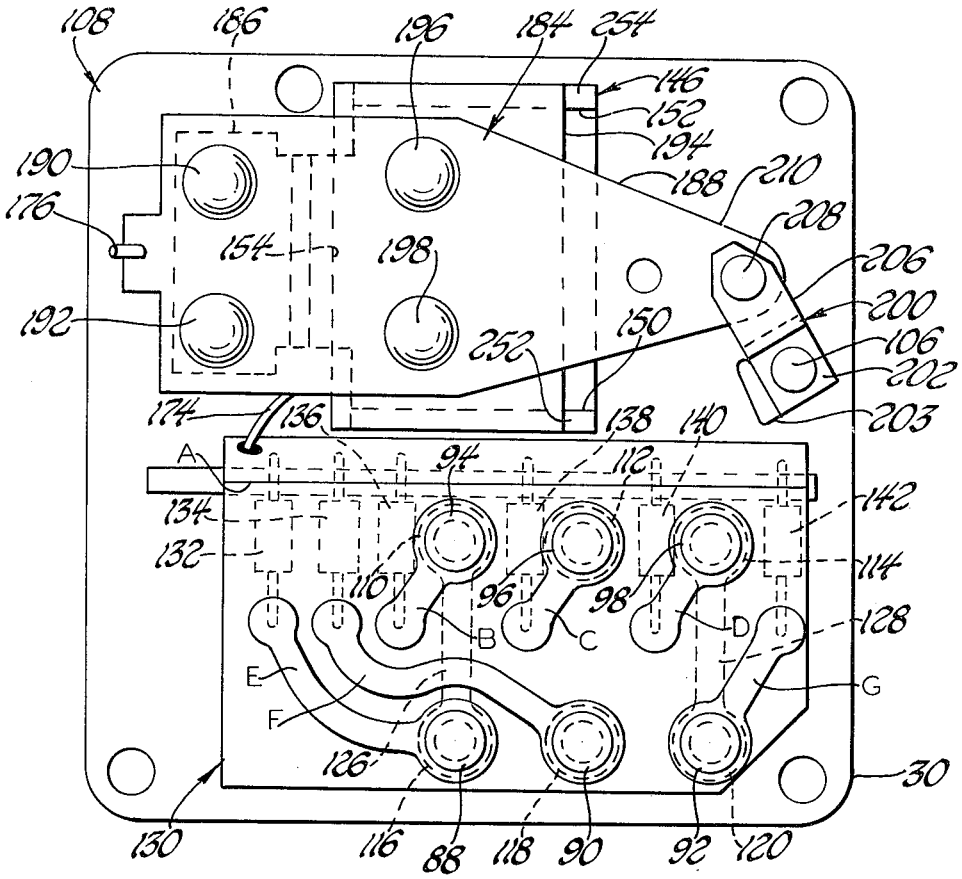
FIG. 4 is a plan view taken generally on the plane of line 4—4 of FIG. 3 and looking in the direction of the arrows.

FIGS. 3 and 4 illustrate a relay assembly 108 and various other electrical components secured to and carried generally on or along the inner surface of cover 30 as to occupy the chamber defined by the housing means 12.

As shown in FIGS. 3, 4, 5, 6 and 7, the inner side of cover 30 is provided with integrally formed generally cylindrical pedestal-like portions 110, 112, 114, 116, 118 and 120 with an aperture 124 formed axially through each of such pedestals for the reception therethrough of respective rivets 94, 96, 98, 88, 90 and 92. Further, in the preferred embodiment, pedestal portions 110 and 116 are interconnected by an integrally formed wall 126 while pedestal portions 114 and 120 are interconnected by an integrally formed wall 128 with such walls 126 and 128 also being integrally formed with the cover 30.

As can be seen, a printed circuit board 130 is mounted against such pedestals 110, 112, 114, 116, 118 and 120 and retained thereagainst as by electrically conductive rivets 94, 96, 98, 88, 90 and 92 which extend through respective apertures 124 and bases 70, 72, 74, 64, 66 and 68 of respective terminals 82, 84, 86, 76, 78 and 80 (FIG. 1) so as to hold such printed circuit board 130, terminals and cover 30 in assembled relationship. As will become apparent, such rivets also serve to complete circuit portions as between respective terminals 76, 78, 80, 82, 84 and 86 and printed circuit portions carried by said board 130.

As best seen in FIG. 4, the upper surface of printed circuit board 130 has formed thereon a plurality of printed circuit portions A, B, C, D, E, F and G with portion A being depicted as a generally straight band-like section serving as conductor means for a plurality of components as, in this instance, diodes 132, 134, 136, 138, 140 and 142 which are situated generally at the underside of the printed circuit board 130 and carried thereby.

As shown in FIG. 4, the respective one ends of printed circuits portions B, C, D, E, F and G are so situated as to be in electrically conductive relationship with rivets 94, 96, 98, 88, 90 and 92, respectively, while the other respective ends of circuit portions B, C, D, E, F and G are connected to printed circuit portion A through diodes 136, 138, 140, 132, 134 and 142, respectively.

Referring to FIGS. 3, 4, 5, 6 and 7, the relay assembly 108 is illustrated as comprising an outer core 146 having a base portion 148 with upwardly directed side wall-like or leg portions 150 and 152 integrally formed therewith. A third upwardly directed leg portion 154 is also integrally formed with base 148. A finger-like tab 156, also formed integrally with base 148, depends downwardly and is received within a suitable cooperating aperture or recess 158, formed in cover 30, to thereby provide for relative angular positioning of the outer core 146. The entire outer core 146 is made of a ferrous material (such as mild steel) so as to provide for a magnetic flux path.

Figure 5:
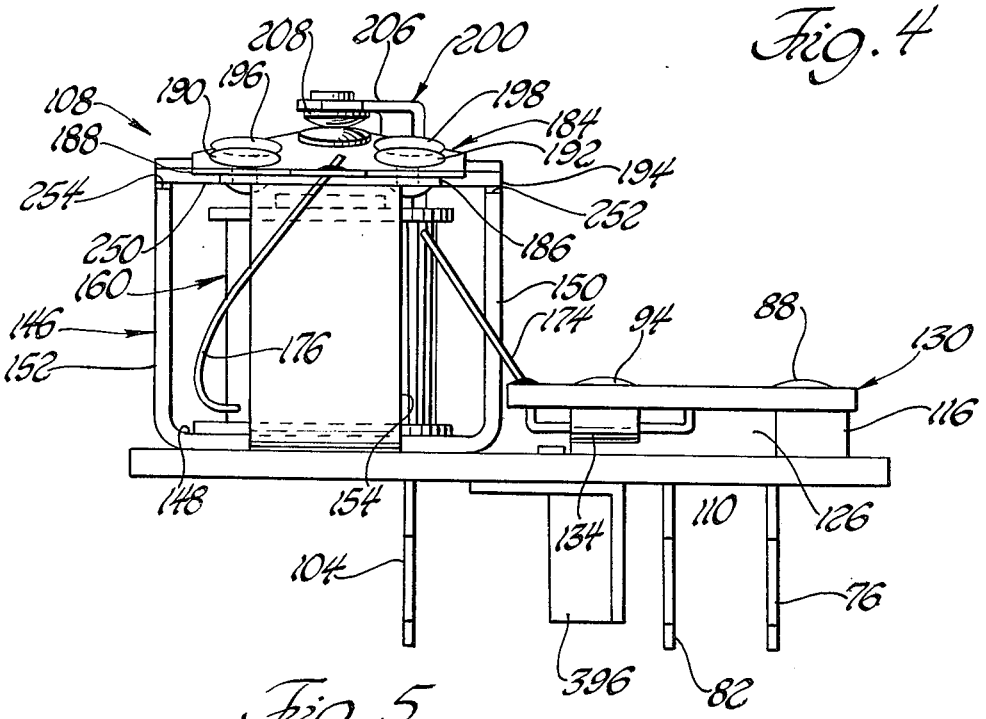
FIG. 5 is an end elevational view taken generally on the plane of line 5—5 of FIG. 3 and looking in the direction of the arrows.

A winding or coil assembly 160 is illustrated as being comprised of a spool 162 having a centrally situated tubular portion 164 terminating at its opposite ends in radially extending upper and lower flange portions 166 and 168 which, in turn, axially contain a winding 170 wound about tubular portion 164. If desired, an outer cover portion 172 may be provided. As fragmentarily illustrated in FIGS. 3, 4, and 5, the winding 170 has one end 174 which, as shown in FIG. 4, is electrically connected to circuit portion A, and a second end 176 which, as shown in FIGS. 3 and 5, is electrically connected to an armature assembly to be described. A centrally disposed vertically extending inner core 178 of ferrous material, preferably of cylindrical configuration, is received within spool tubular portion 164. The lower end of inner core 178 has a shank portion 180 extending through and engaging outer core base 148 as to preferably complete contact therewith. Shank portion 180 also extends through cover 30 and a washer-like retainer 182 wherein the end of shank 180 is peened as to thereby axially secure the coil assembly 160, outer core 146 and inner core 178 to the cover 30 while relative angular alignment is achieved as by the finger-like locator 156 previously described.

An armature assembly 184 is operatively connected to and carried by a laterally extending flange-like mounting portion 186 integrally formed with and at the upper end of leg 154 thereby defining a pedestal-like structure with the armature assembly 184 being cantilevered therefrom.

The armature assembly is preferably comprised of a relatively thin electrically conductive resilient member 188 which is secured at one end to mounting flange 186 as by electrically conductive rivets 190 and 192. In the preferred embodiment, member 188 is comprised of beryllium copper. Generally intermediate opposite ends of member 188, an additional armature plate 194 is carried by and secured to arm member 188 as by electrically conductive rivets 196 and 198. In the preferred embodiment armature plate 194 is comprised of mild steel as, for example, a grade 1020 steel.

A vertically extending electrically conductive pedestal or bracket-like member 200 having a base portion 202 suitably carried atop a raised mounting portion 203, formed integrally with the cover 30, and secured to cover 30, and blade-type terminal 104 as by the electrically conductive rivet 106 has a laterally extending flange-like portion 206 which carries an electrical contact 208 with a crowned contact surface, thereon and suitably secured thereto.

The free or swingable end 210 of resilient armature plate 188 is similarly provided with an electrical contact 212 also preferably having a crowned contact surface, which is suitably secured thereto in electrically conductive relationship therewith. The other end of electrical lead or conductor portion 176 from coil assembly 160 is suitably electrically connected, as by soldering, to a tab at the fixed end of armature plate 188.

It will be noted that in the normal condition (with the circuit through the contacts 208 and 212 closed) the lower edge or surface 250 of armature plate 194 is at an incline with respect to the top edges or surfaces 252 and 254 of side leg portions 150, 152 of outer core 146. The generally wedge-like gap between surface 250 and surfaces 252 and 254 is such as to have the widest opening of such gap directed, generally, toward the contact end or swingable end of armature arm 188. When the coil means 160 is energized, the armature arm 188 and armature plate 194 will, as a unit, generally bendably pivot and swing clockwise about point P. During such energization of coil assembly 160 and corresponding actuation of armature assembly 184, armature arm 188 will swing causing contacts 212 to move away from and out of engagement with fixed contact 208.

As will be noted from an inspection of FIG. 3, when the armature assembly 184 is in its normal (de-energized state) the relative position of fixed contact 208 is such as to cause movable contact 212 to strike thereagainst prior to the end 210 of armature arm 188 moving upwardly a distance sufficient to dissipate essentially all of the resilience in arm 188 about said point P. Consequently, the contacting surfaces of contacts 208 and 212 engage each other but because of the continued resilient force in arm member 188 the armature assembly 184, for the most part, still continues to move somewhat upwardly causing a generally bowed condition to the arm 188 consequently resulting in both a slight rocking and sliding action of contact 212 against and relative to contact 208. This, in turn, results in a wiping of such contact surfaces thereby maintaining the contact surfaces cleaner for a much longer period of time and accordingly greatly increases the useful life of such contacts 208 and 212.

Another important feature which arises from the fact that in the normal or non-energized state the armature plate surface 250 forms a wedge-like gap with respect to upper surfaces 252 and 254 is that initial downward movement of the armature plate 194 is accomplished with the lowest possible resisting spring force of armature arm 188 since it only starts to undergo bending at this time. However, the more armature arm 188 is deflected the more nearly surface 250 approaches surfaces 252 and 254 and, at the same time, such surface 250 progressively becomes more nearly parallel to surfaces 252 and 254. In other words, it can be seen that the increasing resilient resistance, developed by arm 188 during its bending about assumed point P, is compensated for by at least two factors. That is, the magnetic attraction for armature plate 194 increases because surface 250 is moving closer to surfaces 252 and 254 and, not only are such surfaces moving closer but are also undergoing relative rotation causing them to ultimately be parallel to each other. The relative rotation of such ultimately abutting surfaces also, in and of itself, increases the degree of magnetic attraction as compared to their respective positions at initiation of downward movement of armature assembly 184.

Although, in view of the teachings of the invention contained herein it is apparent that various means and structure may be employed whereby the wedge-like gap relationship can be achieved, in the preferred embodiment of the invention such wedge-like gap relationship is attained by inclining the armature arm 188 with respect to the horizontal (as viewed in FIG. 3). The simplest and preferred means for achieving such inclination of armature arm 188 is to form the mounting flange or bracket portion 186 as to have the upper surface 258 thereof in suitably corresponding inclined plane so that when the arm 188 is mounted and secured thereto the cantilevered portion thereof will assume the desired degree of inclination with respect to the horizontal.

Further, the invention provides structure whereby the strength of the magnetic field, for causing downward movement of the armature assembly 184, is increased as compared to the prior art for the same ampere-turns. This is achieved by the use of an inner core 178 and an outer core 146 having upstanding legs 150 and 152. As a consequence of such inner and outer cores, a double magnetic loop is created upon energization of the coil assembly 160 thereby, in turn, creating a higher armature pullin force than otherwise possible.

The benefits of the invention thus far described become even more significant when such are compared to the prior art. That is, prior art armature-actuating coil assemblies, without such double-magnetic loop creating means, required a much greater number of coil turns to attain the same armature pullin force. In most instances, the actual number of such coil turns was so great that the prior art attempted to reduce or somewhat limit the number of coil turns by, in situations where, for example, the contacts were normally open, placing the electrical contacts very close to each other and, at the same time, increasing the spring rate of the armature assembly. This approach by the prior art, however, has not proven to be successful especially where the coil and armature contact assembly, during use, is subjected to any significant degree of shock or vibration. That is, because of the very small contact gap such vibrations cause contact closure even during periods of operation wherein such contact closure is not supposed to occur.

Figure 6:
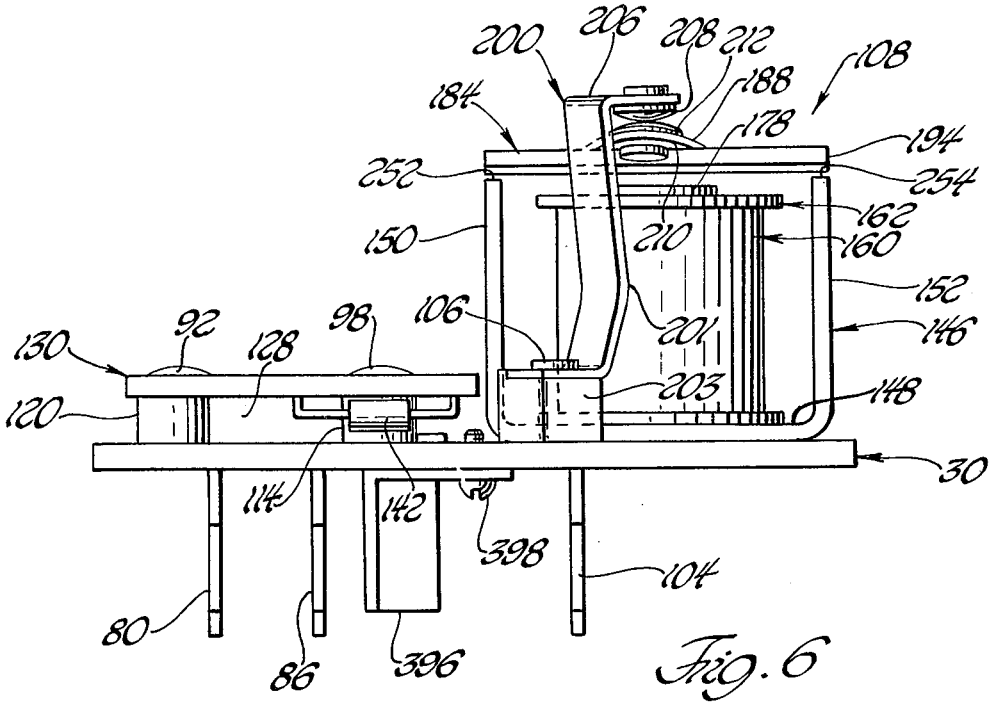
FIG. 6 is an end elevational view taken generally on the plane of line 6—6 of FIG. 3 and looking in the direction of the arrows.
Figure 7:
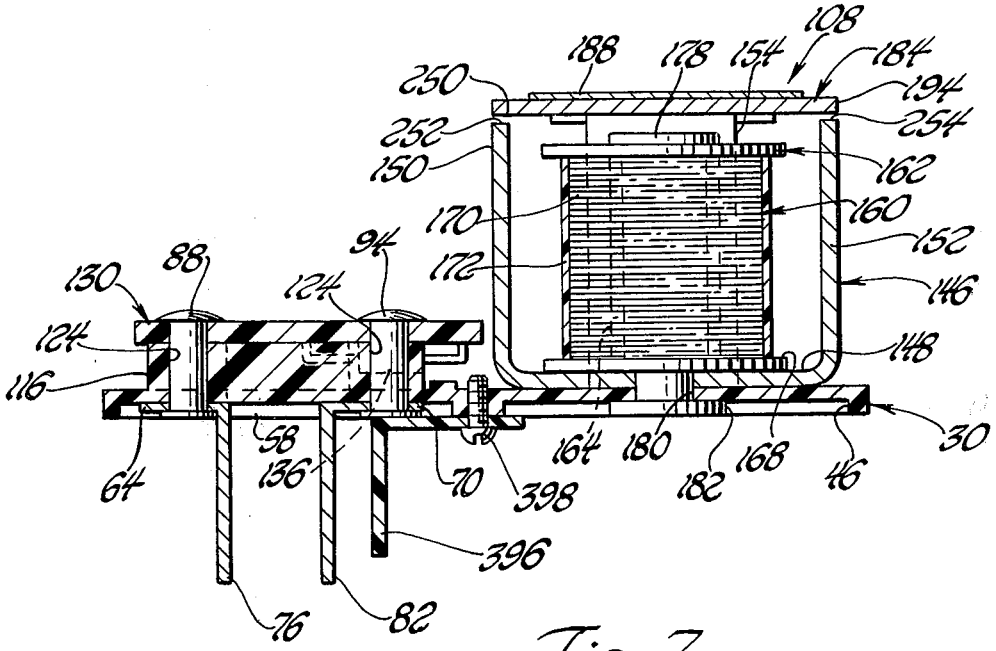
FIG. 7 is a cross-sectional view taken generally on the plane of line 7—7 of FIG. 3 and looking in the direction of the arrows.

With reference to FIGS. 3 and 6, it can be seen that the upwardly directed electrically conductive contact pedestal 200 has its main body 201 bent or bowed. In the preferred embodiment such bowing of the body 201 is made in order to thereby provide for some added degree of general resilience thereto in order to lessen the occurrence of impact fatigue arising from contact 212 striking contact 208 which is eccentrically situated with respect to body 201.

Although housing means 12 may be formed of any suitable material, in the preferred embodiment, the container 14 and cover 30 are preferably formed of glass filled polyester thereby providing for light-weight construction while still retaining high strength. Further, the mounting of the printed circuit board 130 in a spaced relationship to the planar body 44 of cover 30, as by the provision of mounting pedestals 110, 112, 114, 116, 118 and 120 further greatly enhances the overall rigidity of the cover 30 and components carried thereon. The spaced relationship of the printed circuit board 130 further reduces the possibility of such printed cirucit board 130 experiencing undesirable bending or flexing which could have deleterious effects on the adherence of the printed circuit portions as well as possibly cause other failures, as the breaking of such printed circuit portions.

Figure 8:
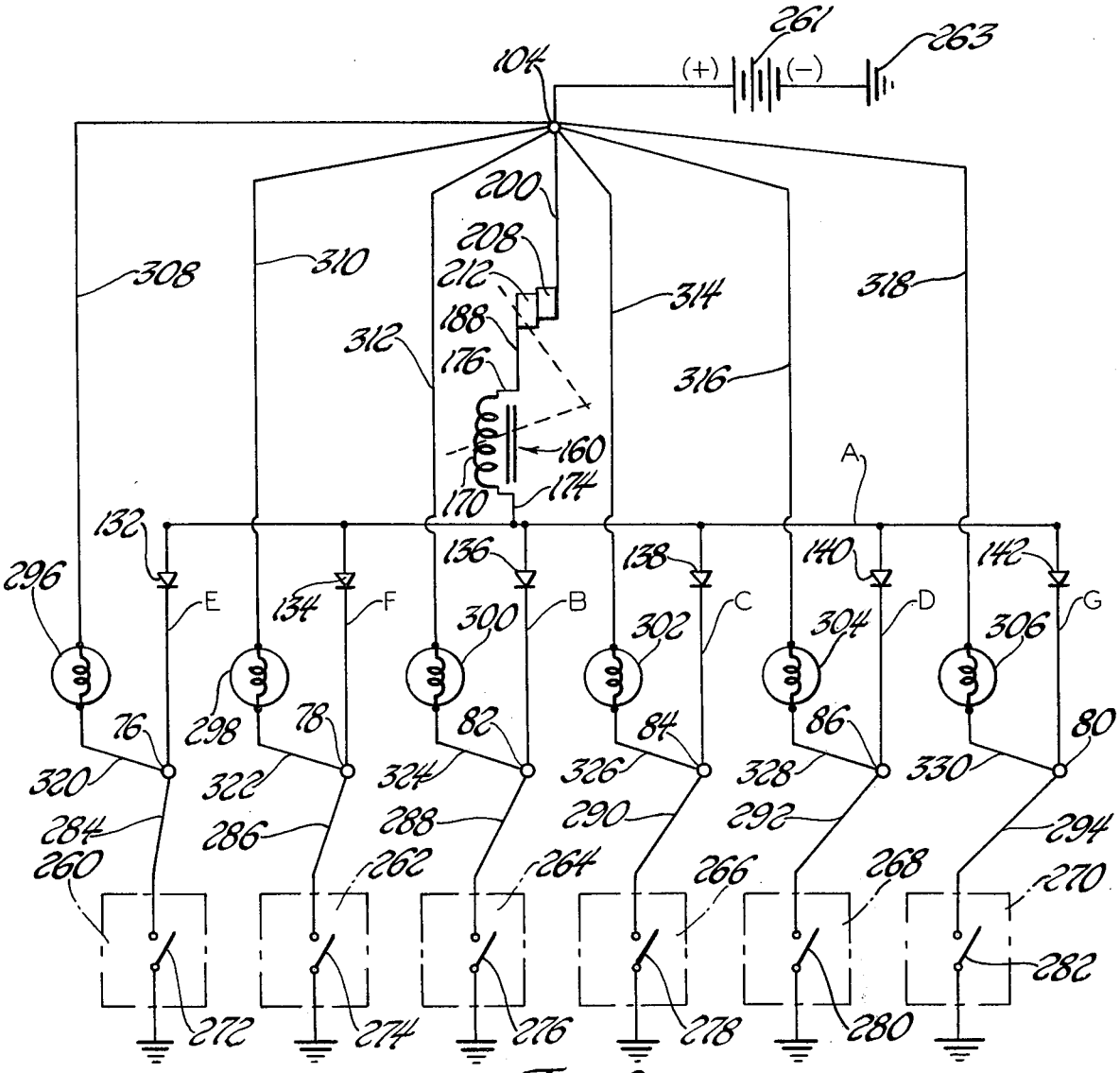
FIG. 8 is a schematic wiring diagram illustrating an overall warning and switching system constructed in accordance with the teachings of the invention.

FIG. 8 is a schematic wiring diagram of the electrical circuitry of the structure of FIGS. 1–7 along with other circuitry comprising the overall system. All elements schematically illustrated in FIG. 8 but corresponding to elements of FIG. 1–7 are identified with like reference numbers.

Referring now in greater detail to FIG. 8, a suitable source of electrical potential 261 has one electrical side thereof electrically connected to terminal or connector 104 while its other electrical side is connected to ground as at 263. A plurality of visual warning devices or lamps 296, 298, 300, 302, 304 and 306 are respectively electrically connected via conductor means 308, 310, 312, 314, 316 and 318 to electrical source 261 or by connection schematically illustrated to terminal 104. The other sides of the same lamps are respectively electrically connected via conductor means 320, 322, 324, 326, 328 and 330 as to terminals 76, 78, 82, 84, 86 and 80.

Various indicia or condition sensing and responsive devices are depicted as at 260, 262, 264, 266, 268 and 270 respectively having switching means 272, 274, 276, 278, 280 and 282 which are electrically connected to ground potential while their other terminals are respectively electrically connected via conductor means 284, 286, 288, 290, 292 and 294 as to terminals 76, 78, 82, 84, 86 and 80. The various sensors 260, 262, 264, 266, 268 and 270 may, of course, be responsive to any desired or selected conditions as, for example, in a truck-type vehicle; (a) sensing means 260 could be responsive to the fuel level within the vehicular fuel tank as to result in switching means 272 closing upon a predetermined minimum fuel level being attained within such tank; (b) sensing means 262 could be responsive to the vehicular engine oil temperature as to result in switching means 274 closing upon the oil within such engine reaching a predetermined maximum temperature; (c) sensing means 264 could be responsive to closure of the vehicular doors so that switching means 276 would become closed if the vehicle door or doors were not fully closed; (d) sensing means 266 could be responsive to vehicular engine speed as to result in switching means 278 becoming closed upon the engine attaining a predetermined maximum safe speed; (e) sensing means 268 could be responsive to engine coolant temperature as to result in switching means 280 closing whenever the coolant reaches a predetermined maximum safe temperature; and (f) sensing means 270 could be responsive to the vehicular engine oil pressure as to cause switching means 282 to close in the event the pressure of such oil decreases to a predetermined minimum pressure.

In view of the preceding assumed sensing means, if the fuel level were to decrease to the said predetermined minimum level, sensor 260 would respond by causing switching means 272 to close thereby completing a circuit from electrical source 261, through connector 104, contact pedestal 200, fixed or stationary contact 208, movable contact 212, armature arm 188, conductor 176, coil winding 170, conductor 174, printed circuit portion A, diode 132, printed circuit portion E, terminal 76, conductor means 284, switch means 272 and back to ground potential. Simultaneously, a parallel branch circuit is also completed that being through conductor means 308, lamp load 296 and conductor means 320 to terminal 76. Consequently, a visual warning is provided by virtue of the energization of lamp 296 while an auditory warning is provided by virtue of the cyclical energization and de-energization of the coil 170 with the attendant striking of contact 212 against fixed contact 208. Since the entire relay assembly is mounted on the cover member 30, such cover member serves as a sounding board to further amplify the auditory signal to the vehicle operator.

Similarly, as any of the other sensors 262, 264, 266, 268 and 270 are energized to close their respective associated circuits, the same auditory signal or warning is created and the particular warning lamp in parallel to such closed circuit will become energized to create the related visual warning signal.

It should be mentioned that the electrical loads 296, 298, 300, 302, 304 and 306 may, in fact, be related electrically energizable means which, in turn, upon being so energized exhibit a related control function as, for example, shutting-down the engine or even automatically shifting the vehicular power-train transmission into a different gear ratio.

With respect to the structure as shown in FIGS. 1–7, the preferred method and means of respectively interconnecting the electrical loads or lamps 296, 298, 300, 302, 304 and 306 and the sensors 260, 262, 264, 266, 268 and 270 to the respective terminals 76, 78, 82, 84, 86 and 80 is by employing a female type plug or rocket wherein the respective contacts carried by such plug or rocket are connected to: (a) both conductor means 320 and 284 for plug-in connection with terminal 76; (b) both conductor means 322 and 286 for plug-in connection with terminal 78; (c) both conductor means 324 and 288 for plug-in connection with terminal 82; (d) both conductor means 326 and 290 for plug-in connection with terminal 84; (e) both conductor means 328 and 292 for plug-in connection with terminal 86; and (f) both conductor means 330 and 294 for plug-in connection with terminal 80.

Figure 9:
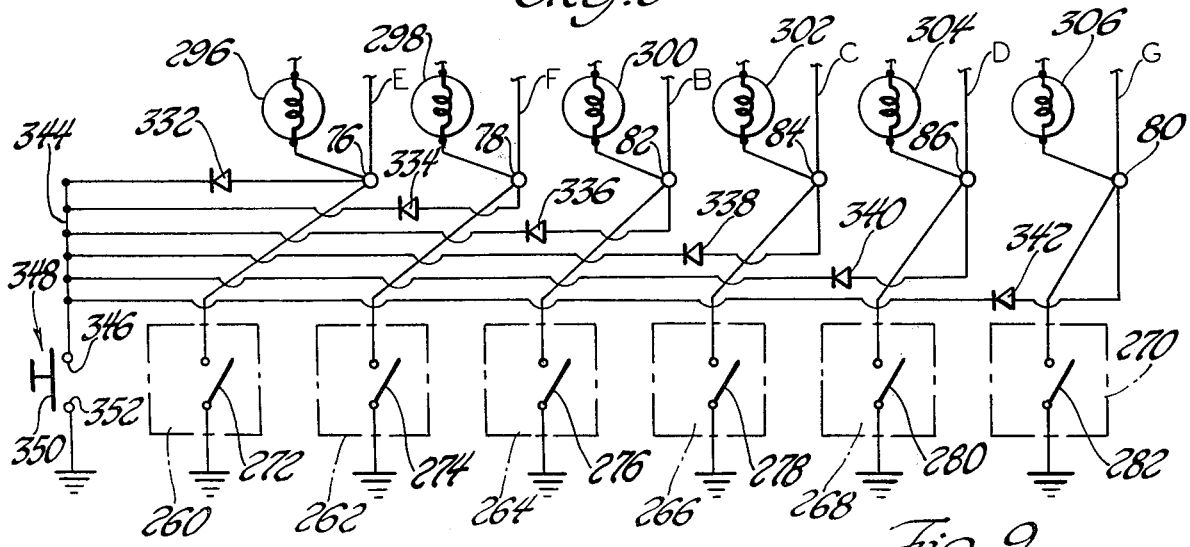
FIG. 9 is a partial schematic diagram illustrating a modification to the circuitry of FIG. 8.

FIG. 9 illustrates a fragmentary portion of the schematic circuitry of FIG. 8 but with a modification thereto. In the embodiment of FIG. 9, additional diode means 332, 334, 336, 338, 340 and 342 are, at their respective one ends, electrically connected to terminals 76, 78, 82, 84, 86 and 80, respectively, while each of the other ends of such additional diode means is connected to conductor means 344 leading to a terminal 346 of a normally open push-button switch assembly 348 which has a movable contact 350 effective to, when depressed, close the circuit across cooperating contacts 346 and 352 to complete that circuit to ground. The purpose of the push-button switch assembly 348 is to enable the vehicle operator to manually depress button contact 350 and close all the circuits through all the visual warning means as well as the auditory warning means to thereby check and determine whether all of such elements are operative.

The provision of the additional diode means 332, 334, 336, 338, 340 and 342 is to prevent the energization of any circuits other than that circuitry directly related to a particular sensor means which may have responded to the occurrence of a selected predetermined condition or indicia of operation.

The circuits of both FIG. 8 and 9 are depicted as negative-ground type circuits. However, it should be apparent that each of such circuits could be of the positive-ground type with the only change necessary being that of reversing the various diode means.

It should be made clear that the invention is not limited to the employment of six or any specific number of separate circuits for accommodating a like number of sensor means. That is, referring to FIG. 1, and other related Figures, in same applications of the invention it is conceivable that, for example, terminals 80 and 86 would not be needed and therefore such could be dispensed with. If such were the case, then (referring to FIG. 8) related lamps 304, 306, conductor means 316, 328, 318 and 330, sensor means 268, 270 and related conductor means 292 and 294 would also be eliminated. Whether diodes 140 and 142 were or were not carried by the printed circuit board 130 would not matter since they would merely terminate in open circuits if such diodes were carried by the printed circuit board.

Figure 10:
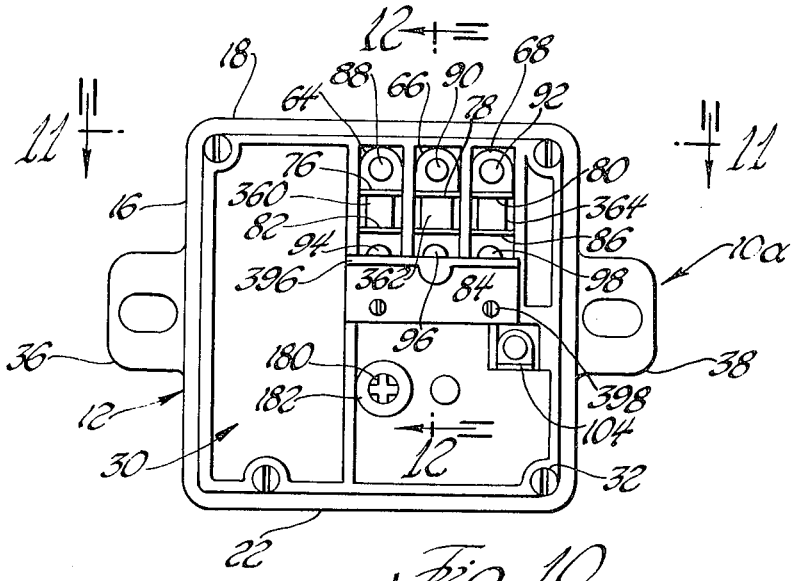
FIG. 10 is a view similar to that of FIG. 1 but illustrating a modified embodiment of the structure of FIG. 1.

FIG. 10 illustrates a modification of the invention shown in FIGS. 1–7. All elements in FIGS. 10, 11, 12 and 13 which are like or similar to those of the preceding Figures are identified with like reference numbers. Further, some of the reference numbers in FIGS. 10, 11, 12 and 13 have purposely been omitted for sake of clarity of the views.

The main difference as between the embodiment of FIGS. 1–7 and FIGS. 10, 11, 12 and 13 is that in the apparatus 10*a* additional jumper-like electrically conductive bridging members 360, 362 and 364 are provided within pockets 58, 60, 62 as to be situated directly beneath the respective pairs of terminals 76, and 82, 78 and 84, and 80 and 86 as to complete electrical paths therebetween. Such bridging members may be retained by the same electrically conductive rivets as retain the coacting terminals in assembled relationship.

Figure 11:
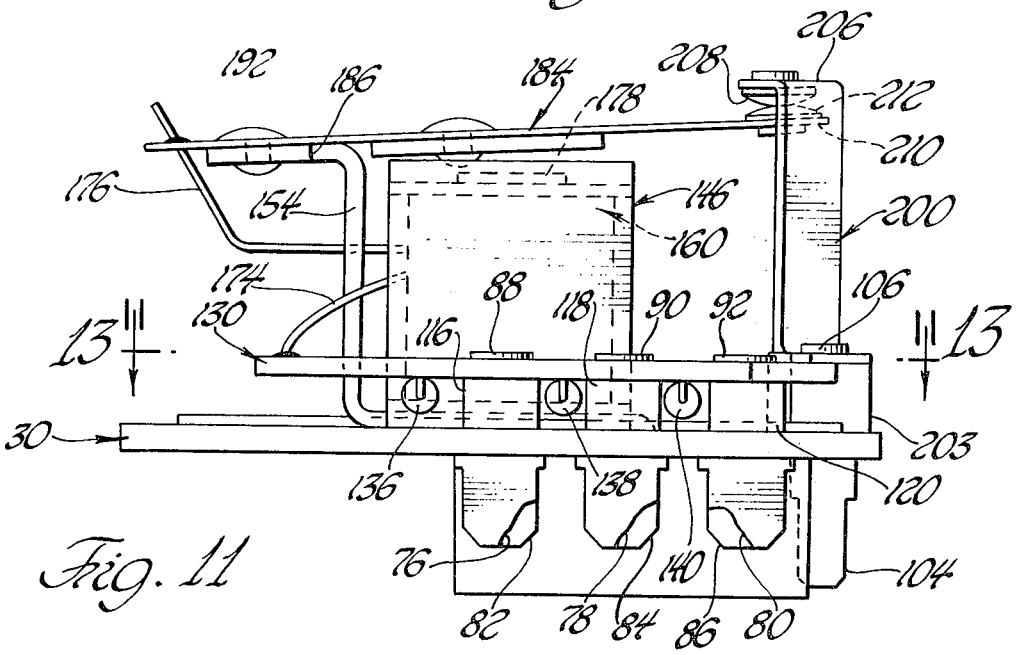
FIG. 11 is a view similar to FIG. 3 but taken generally on the plane of line 11—11 of FIG. 10 and looking in the direction of the arrows.
Figure 12:
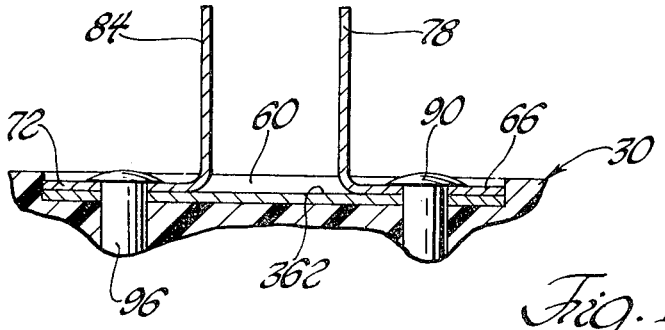
FIG. 12 is an enlarged fragmentary cross-sectional view taken generally on the plane of line 12—12 of FIG. 10 and looking in the direction of the arrows.
Figure 13:
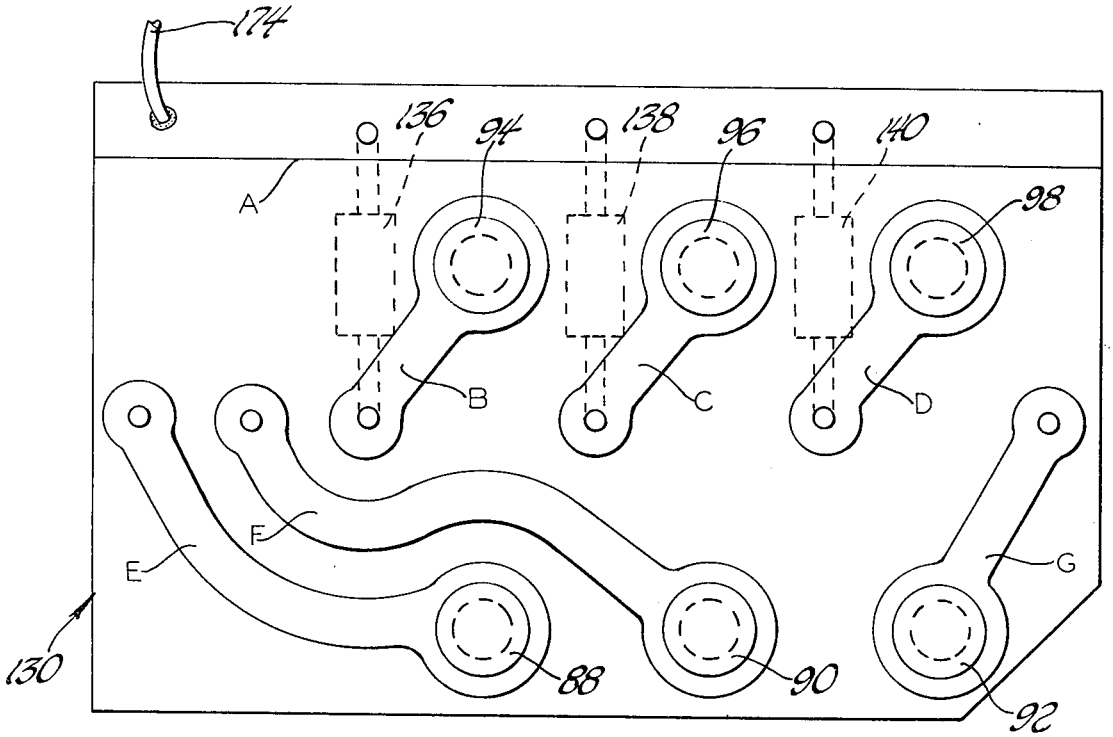
FIG. 13 is an enlarged view of the printed circuit board of FIG. 11 taken generally on the plane of line 13—13 of FIG. 11 and looking in the direction of the arrows.

FIG. 13, an enlarged view taken generally on the plane of line 13—13 of FIG. 11, illustrates that in this particular embodiment only three diodes 136, 138 and 140 are employed. The significance of this will be better appreciated from FIG. 14 which depicts the corresponding circuitry by schematic diagram. All elements in FIG. 14 which are like or similar to those of FIG. 8 are identified with like reference numbers.

Figure 14:
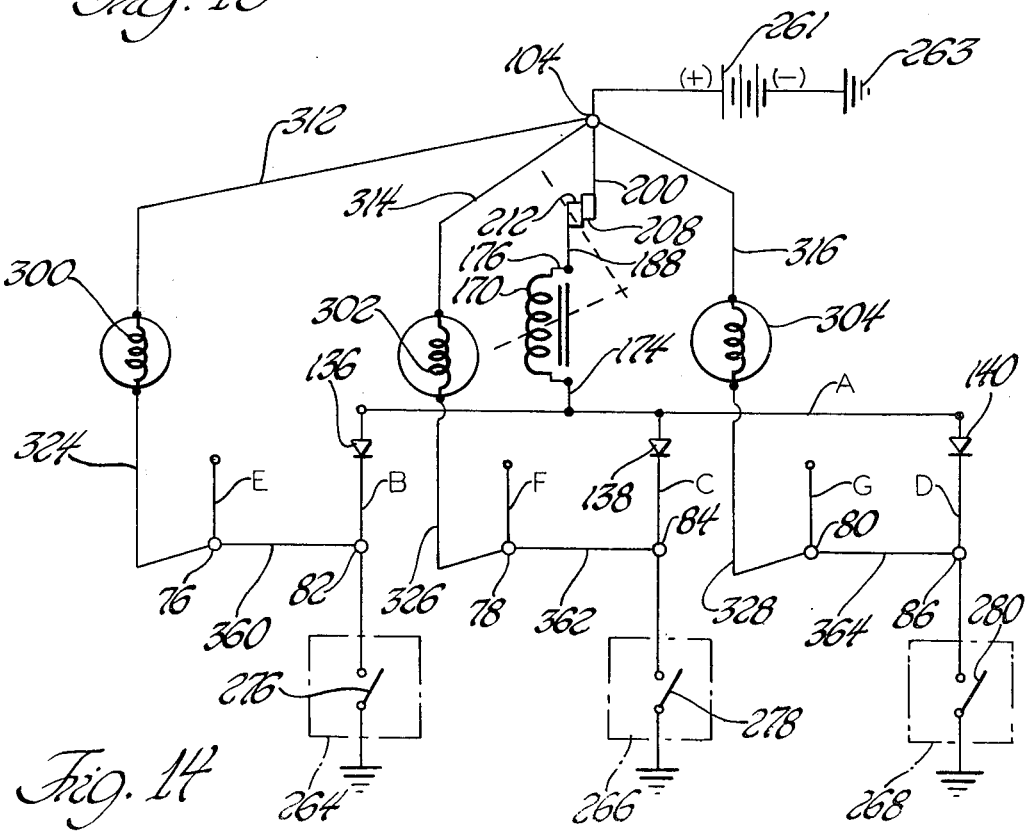
FIG. 14 is a schematic wiring diagram of the system circuitry with regard to the embodiment of FIGS. 10, 11, 12 and 13.

In comparing the circuits of FIGS. 14 and 8, it can be seen that in FIG. 14, because of the absence of diodes 132, 134 and 142, the printed circuit portions E, F and G are open with respect to printed circuit portion A. Further, conductor means 324, 326 and 328 previously connectable as to terminals 82, 84 and 86, respectively, are now depicted as electrically connected to terminals 76, 78 and 80 respectively. The circuit is further completed by bridging members 360, 362, 364 respectively interconnecting terminal pairs 76 and 82, 78 and 84, and 80 and 86. The operation of the circuitry is as that described with reference to FIG. 8.

The benefit of providing such jumper-like bridging members is to accommodate the use of female type electrical harness connector blocks where a separate electrical contact therein is provided for each warning lamp and a separate electrical contact therein is provided for each sensor assembly. It should, of course, be apparent from an inspection of FIG. 14 that the provision of diodes 132, 134 and 142 as between printed circuit portion A and respective circuit portions E, F and G would, in no way, impair the operation thereof.

Figure 15:
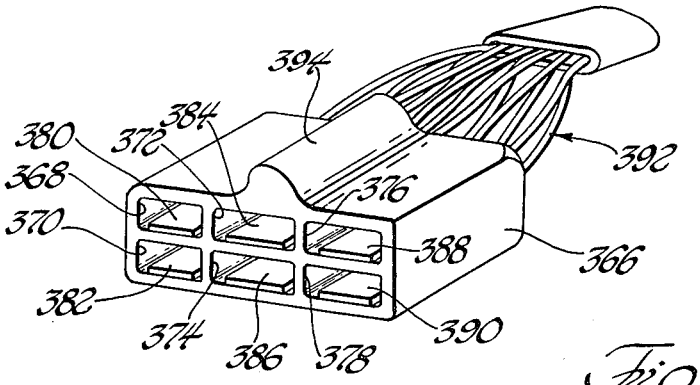
FIG. 15 is a perspective view of a typical wiring harness multiple contact connector or housing.

FIG. 15 typically illustrates a multiple contact connector having a body 366 with passageways 368, 370, 372, 374, 376 and 378 formed therethrough with suitable internally formed means for retaining within such passageways electrical terminals or contacts 380, 382, 384, 386, 388 and 390 which, in turn, are illustrated as being electrically connected to, in this example, a total of twelve wires or conductors 392. That is, each of the contacts 380, 382, 384, 386, 388 and 390 would be electrically connected to two of such conductors 392 with one of such two being, in turn, connected to an associated sensor means while the other of such two would be connected to an associated visual warning device. It is such an arrangement which is primarily intended for connection to the terminals 76, 82, 78, 84, 86 and 80 of the structure of FIGS. 1–7 and as depicted, schematically, in FIGS. 8 and 9.

Further a similar connector 366 is intended to be employed in respect to the structure of FIGS. 10, 11 and 12 and 13. In that connector, the primary difference would be that, for example, contacts 390, 386 and 382 would each be connected to only a single conductor and such conductor, in turn, would be connected to associated sensor means while contacts 388, 384 and 380 would each be connected to only a single conductor and such conductor, in turn, would be connected to an associated visual warning device.

Also, as shown in FIG. 15, such connector bodies are usually provided with a protruding portion 394 (or the functional equivalent thereof) which serves to properly orient the connector body, and therefore the contacts carried thereby, with respect to the terminals to which it is to be connected as to thereby assure the connection of one particular conductor (or a pair) with only another particular conductor and with none other. Accordingly, in order to employ such polarized connectors to best advantage in the invention, means such as a polarizing plate member 396 is suitably secured, as by screws 398, to the cover 30 in order to thereby permit the connection between the contacts within the connector and the coacting terminals to occur only when the connector body 366 is positioned so that, for example, protrusion 394 is situated generally outwardly while the relatively thinner wall of the conductor 366 is accepted between plate member 396 and terminals 82, 84 and 86. By having the plate member 396 detachably secured, it makes it possible to re-position the location of plate 396 in order to accommodate a different form or configuration of polarized connector body.

Figure 16:
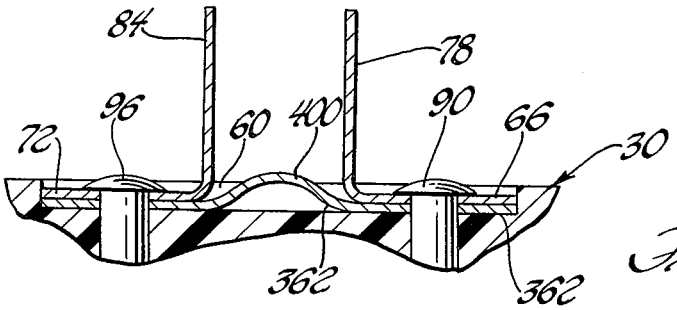
FIG. 16 is a view similar to FIG. 12 but illustrating a further modification.

FIG. 16 illustrates a modified form of the structure shown in FIGS. 10, 11, 12 and 13. That is, FIG. 16 typically illustrates a modified form or configuration of the jumper-like bridging members 360, 362, 364. In the modification of FIG. 16, it is contemplated that each of such bridging members 360, 362 and 364 would have a generally medially situated upwardly bowed portion 400 so as not to effectively interfere with the connector body 366 but at a height to provide at least some reasonable access thereto. Assuming that in such a modified form, there were actually six terminals 76, 78, 80, 82, 84 and 86 as shown in FIG. 10, it is further contemplated that all six diodes, namely diodes 132, 134, 136, 138, 140 and 142 would then be carried by the printed circuit board 130, in the manner depicted in FIG. 4, instead of only diodes 136, 138 and 140 as shown in FIG. 13. This would then provide a universal type assembly, especially if produced as a replacement item for general applications, which would fulfill the requirements regardless of the type of wiring harness that such apparatus may be required to be connected to. That is, if the wiring harness is the type contemplated and described in reference to FIGS. 10, 11, 12 13 and 14 nothing would have to be done to the apparatus of FIG. 16; however, if the wiring harness was of the type contemplated and described with reference to FIGS. 1–9, all that would have to be done is to cut the bowed portions 400 of each of such bridging members 360, 362 and 364. It should, of course, be also apparent that combinations thereof would be possible as by, for example, cutting one or more selected bridging members while leaving the remaining intact.

Although only a limited number of preferred embodiments and modifications of the invention have been disclosed and described, it is apparent that other embodiments and modifications of the invention are possible within the scope of the appended claims.

I claim:

1. A warning assembly, comprising an auditory signal generating means, a plurality of first terminals adapted for connection to a plurality of associated condition sensing means, second terminals means adapted for connection to an associated source of electrical potential, first circuit means effective for electrically interconnecting said first terminals to a first electrical terminal of said auditory signal generating means, second circuit means effective for electrically interconnecting said second terminal means to a second electrical terminal of said auditory signal generating means, and diode means in said first circuit means situated generally between said first electrical terminal of said auditory signal generating means and said first terminals, said first and second circuit means being effective for electrical connection to associated electrically energizable visual warning means in a manner whereby one electrical side of said visual warning means is electrically connected to said source of electrical potential and an other electrical side of each of said visual warning means is electrically connected to said first circuit means at locations situated as to cause said diode means to be generally between said locations and said auditory signal generating means.

2. A warning assembly according to claim 1 wherein said first circuit means comprises a plurality of printed circuit portions, wherein said diode means electrically interconnect at least certain of said printed circuit portions, and further comprising housing means, said housing means comprising a container having side wall means and an end wall for closure of a first end of said side wall means, a cover member adapted to be detachably secured to a second open end of said side wall means opposite to said first end, and wherein said auditory signal generating means said first and second circuit means and said first and second terminal means are carried by said cover member in a manner whereby upon said cover member being secured to said container said first and second terminal means are situated externally of said cover member whereas said auditory signal generating means and said first and second circuit means are situated inwardly of said cover member and disposed within the confines of said side wall means said end wall and said cover member, and further comprising printed circuit board means, wherein said plurality of printed circuit portions are formed on said printed circuit board means, said printed circuit board means being secured to said cover member but spaced therefrom by projecting printed circuit board mounting means, said auditory signal generating means comprising an electro-magnetic relay assembly, said relay assembly comprising a wire coil assembly, a first inner ferrous core situated generally within said coil assembly to provide for a first magnetic flux path, a second outer ferrous core situated generally both below and outwardly of said coil assembly, said outer core comprising first and second leg portions extending generally alongside of and on opposite sides of said coil assembly as to have generally upwardly directed end surfaces, said second core being effective to provide a second magnetic flux path, a pedestal portion supporting a cantilevered armature assembly having a generally swingable end portion with a first electrical contact carried thereby, a ferrous member comprising a portion of said armature assembly and situated as to be influenced and acted upon by said magnetic flux, and a stationary electrical contact effective to be in a normally closed condition with respect to said first electrical contact.

3. A warning assembly according to claim 2 wherein said mounting means are formed integrally with said cover member and define a plurality of spaced end-like seating surfaces for abuttingly engaging said printed circuit board means.

4. A warning assembly according to claim 2 and further comprising detachably securable polorizing means carried by said cover member and situated externally thereof as to be in a selected proximity to said plurality of first terminal means.

5. Auditory alarm means for use in continuity testing circuit means wherein said continuity testing circuit means comprises a plurality of separate electrical circuits at least certain of which comprise visual signal generating means effective for visually indicating a particular condition respectively sensed by such separate electrical circuits, said auditory alarm means comprising body means, sound generating means fixedly carried by said body means, said sound generating means comprising electro-magnetic relay means, said relay means comprising a wire coil assembly operatively secured to said body means, ferrous core means for providing a magnetic flux path, a pedestal portion operatively fixedly secured to said body means and supporting a cantilevered armature assembly having a generally swingable end portion with first electrical contact means carried thereby, stationary electrical contact means operatively fixedly secured to said body means, said electrical contact means being adapted to be alternatively closed against and opened from said stationary electrical contact means as a consequence of the electrical energization and de-energization of said coil means, printed circuit carrying means, said carrying means being fixedly secured to said body means, printed circuit means formed on said carrying means, said printed circuit means comprising a primary printed circuit portion and a plurality of secondary circuit portions spaced from each other and said primary printed circuit portion, first conductor means electrically interconnecting one electrical end of said coil means to said first electrical contact means, second conductor means electrically interconnecting an other end of said coil means to said primary printed circuit portion, a plurality of diode means electrically connected to said primary printed circuit portion and at least to certain of said plurality of secondary circuit portions, first terminal means carried by said body means effective for electrically connecting a first portion of said continuity testing circuit means to said stationary electrical contact means, and a plurality of second terminal means carried by said body means effective for respectively electrically connecting at least certain of said plurality of secondary circuit portions to at least certain of said separate electrical circuits.

6. Auditory alarm means according to claim 5 wherein said body means comprises at least a portion of generally enveloping housing means, said housing means comprising a cuplike member having side wall means and an end wall cooperating with said side wall means to thereby form an end closure wall, said cuplike member having an open end opposite to said end closure wall, said open end being adapted to cooperate with said body means as to enable said body means to close said open end, wherein said first and second terminal means are carried by said body means as to be disposed externally of said body means when said body means closes said open end, and further comprising polorizing means carried by said body means so as to also be situated externally of said body means when said body means closes said open end.

7. Auditory alarm means according to claim 5 and further comprising polorizing means carried by said body means, said polorizing means being situated in a preselected position with respect to said second terminal means to thereby permit the connection of said separate electrical circuits to said second terminal means in only a predeterminedly prescribed relationship.

8. Auditory alarm means according to claim 5 and further comprising electrical shunt means carried by said body means, said shunt means electrically interconnecting at least a certain pair of said second terminal means.

9. A warning assembly according to claim 1 and further comprising electrical shunt means carried by said body means, said shunt means electrically interconnecting at least a certain pair of said first terminals.

10. A warning assembly according to claim 9 wherein said shunt means comprises a generally intermediate portion formed as to be generally extending away from said body means, said intermediate portion being thusly positioned as to enable the subsequent selective severance thereof and the electrical opening of such electrical circuit otherwise provided by such severed shunt.

11. Auditory alarm means according to claim 8 wherein said shunt means comprises a generally intermediate portion formed as to be generally extending away from said body means, said intermediate portion being thusly positioned as to enable the subsequent selective severance thereof and the electrical opening of such electrical circuit otherwise provided by such severed shunt.

12. An auditory alarm assembly, comprising alarm housing means, said housing means comprising a cuplike housing section having side wall means and a first end wall cooperating with said side wall means to form a first end closure, a second separate end wall adapted to be detachably secured to said housing section as to thereby form a second end closure opposite to said first end closure, said second end wall when secured to said housing section defining inner wall surface means and outer wall surface means, said inner wall surface means comprising spaced first protuberant portions projecting generally inwardly of said housing means and having generally coplanar mounting surface means formed at the end thereof, a printed circuit board situated against said coplanar mounting surface means, a plurality of first electrical terminals carried against and by said second wall as to be operatively against said outer wall surface means and extending outwardly away from said outer wall surface means, a plurality of printed circuit portions carried by said printed circuit board, electrically conductive mechanical fastening means extending through at least certain of said protuberant portions and said printed circuit board and at least certain of said first electrical terminals so as to secure said printed circuit board said second wall and said at least certain of said first electrical terminals into a fixed assembled relationship, said fastening means also engaging at least certain of said printed circuit portions to thereby establish an electrically conductive path as between said at least certain of said printed circuit portions and said at least certain of said first electrical terminals, diode means interconnecting at least certain of said printed circuit portions to each other, said diode means being physically carried by said printed circuit board as to be spaced from said second wall, an electro-magnetic relay assembly secured to and carried by said second wall as to be operatively against said inner wall surface means and projecting generally inwardly of said housing means, said relay assembly comprising electrically energizeable coil means and armature means movable in response to energization of said coil means, an electrically conductive pedestal member operatively carried against inner surface means as to be projecting generally inwardly of said housing means, a first electrical contact carried by said armature means, a second fixed electrical contact carried by said pedestal member and adapted to be normally in engagement with said first electrical contact, a first electrical end of said coil means being electrically connected to certain of said printed circuit portions, a second electrical end of said coil means being electrically connected to said armature means as to thereby be in conductive relationship to said first electrical contact, second terminal means carried by said second wall operatively against said outer surface means as to be projecting generally outwardly away from said second wall, additional electrically conductive mechanical fastening means extending through said second wall said pedestal member and said second terminal means as to thereby secure said pedestal member and said second terminal means in fixed assembled relationship to said second wall, and separate polorizing means selectively fixedly secured to said second wall as to be situated operatively against said outer wall surface means and positioned in preselected proximity to said first electrical terminals.

* * * * *

UNITED STATES PATENT OFFICE

CERTIFICATE OF CORRECTION

Patent No. 3,950,745 Dated April 13, 1976

Inventor(s) GERALD K. MILLER

It is certified that error appears in the above-identified patent and that said Letters Patent are hereby corrected as shown below:

Column 2, line 15, after "the" and before "container" cancel "other" and substitute therefor --- outer ---.

Column 3, line 12, change "conainer" to --- container ---.

Column 5, line 13, after "208" insert --- preferably ---.

Column 6, line 41, change "pullin" to --- pull-in ---.

Column 6, line 47, change "pullin" to --- pull-in ---.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*